United States Patent [19]

Siiberg

[11] Patent Number: 4,517,542

[45] Date of Patent: May 14, 1985

[54] VOLTAGE AND TEMPERATURE COMPENSATED TIME DELAY RELAY

[75] Inventor: Hemming G. Siiberg, New Providence, N.J.

[73] Assignee: Edison International Inc., Rolling Meadows, Ill.

[21] Appl. No.: 435,073

[22] Filed: Oct. 18, 1982

[51] Int. Cl.[3] ..... H01H 61/06

[52] U.S. Cl. ..... 337/92; 337/101; 337/369

[58] Field of Search ..... 337/92, 93, 51, 369, 337/99, 101; 340/81 R, 81 F, 82

[56] References Cited

U.S. PATENT DOCUMENTS

| | | | |
|---|---|---|---|
| 2,792,533 | 5/1957 | Richards | 337/101 |
| 2,889,429 | 6/1959 | Mundt | 337/92 |
| 3,364,322 | 1/1968 | Siiberg | 337/92 |
| 3,601,736 | 8/1971 | Sepe | 337/101 |
| 3,855,562 | 12/1974 | Rhee | 337/101 |

*Primary Examiner*—Harold Broome

*Attorney, Agent, or Firm*—Thomas G. Anderson; Jon Carl Gealow; James A. Gabala

[57] ABSTRACT

A temperature and voltage compensated time delay relay includes first and second bimetallic, contact carrying elements chosen to deflect in a similar manner in accordance with variations in ambient temperature for maintaining the contact gap therebetween substantially constant despite ambient temperature changes. A heater coil is wrapped about a first one of the elements (active element) for controlling the deflection thereof toward the second element (stationary element) for closing the contacts of the elements in a predetermined time period. An automotive flasher circuit having normally closed contacts and a flashing rate "on" time which varies inversely proportionally with an increase in supply voltage, is coupled electrically between the supply voltage and bimetallic element heating coil to control and keep relatively constant the rate of heat rise in the active bimetallic element and thus to maintain the time delay period of the relay relatively constant.

8 Claims, 2 Drawing Figures

VOLTAGE AND TEMPERATURE COMPENSATED TIME DELAY RELAY

BACKGROUND OF THE INVENTION

This invention relates generally to time delay relays and more particularly to such a relay which is both temperature and voltage compensated.

Time delay relays or switches of the type including an active bimetallic element carrying a contact and arranged for closing and opening with respect to a second contact carrying element in accordance with heat applied to the active bimetallic element by an electrically operated heater coil wrapped thereabout, are well know in the art.

In such heat activated time delay relays, consistent operation thereof may be disrupted because of variations in ambient temperature and voltage variations of the source supplying energy to the heater coil.

In many time delay relays of the type described, ambient temperature compensation is achieved by introducing, as the second contact carrying element, a second bimetallic element which is selected to move with the active bimetallic element as the ambient temperature varies, thus maintaining the contact gap between elements relatively consistent over a wide temperature range; i.e. −40° F. to 180° F. See for example U.S. Pat. Nos., 2,792,533; 2,889,429; 3,601,736 and 3,855,562.

To achieve, from a time delay relay of the aforementioned type, a consistent time delay when voltage applied to the heater coil of the active bimetallic element varies, is more difficult. In this case, either the contact gap between elements may be varied with voltage or the power dissipation in the heater coil may be controlled or regulated in accordance with voltage variations.

SUMMARY OF THE INVENTION

Accordingly, it is a primary object of the present invention to provide an improved time delay relay of the aforementioned type which is both temperature and voltage compensated.

It is another object of the present invention to provide a time delay relay of the aforementioned type in which compensation for voltage variations of the power source supplying energy to the heater coil of the active bimetallic element is accomplished by varying the average power in the heater coil in accordance with variations in the supply voltage.

It is still another object of the present invention to provide an improved time delay relay which is both temperature and voltage compensated and which is relatively simple in construction, but effective in operation.

Briefly, a preferred embodiment of a time delay relay according to the invention includes first and second bimetallic contact carrying elements chosen to deflect in a substantially like manner in accordance with variations in ambient temperature for maintaining the contact gap therebetween substantially constant despite such ambient temperature variations. A heater coil is wound about the first one of the bimetallic elements, making it the active element.

A conventional shunt type automotive vehicle lamp flasher having normally closed contacts, by design, having a flashing rate which varies in accordance with the input voltage supplied thereto, is connected between the voltage source and the heater coil. The flasher heater coil and bimetallic element heater coil are connected in electrical parallel relation. The "on" time of the coils is controlled by the normally closed flasher contacts. The delay time of the relay is dependent upon the time of movement of the active bimetallic element toward the other contact carrying element.

In the case of the flasher employed, the lower the magnitude of voltage applied thereto, the greater "on" time; i.e. closed contact time, and longer the application of power to the heater coil of the active bimetallic element. When using the selected flasher, the cooling or "off" time of the heater coil remains constant whereas the heating or "on" time varies inversely proportionally with an increase in the supply voltage; i.e. a higher magnitude of supply voltage produces a shorter "on" time.

DETAILED DESCRIPTION OF THE DRAWING

Figure 1:
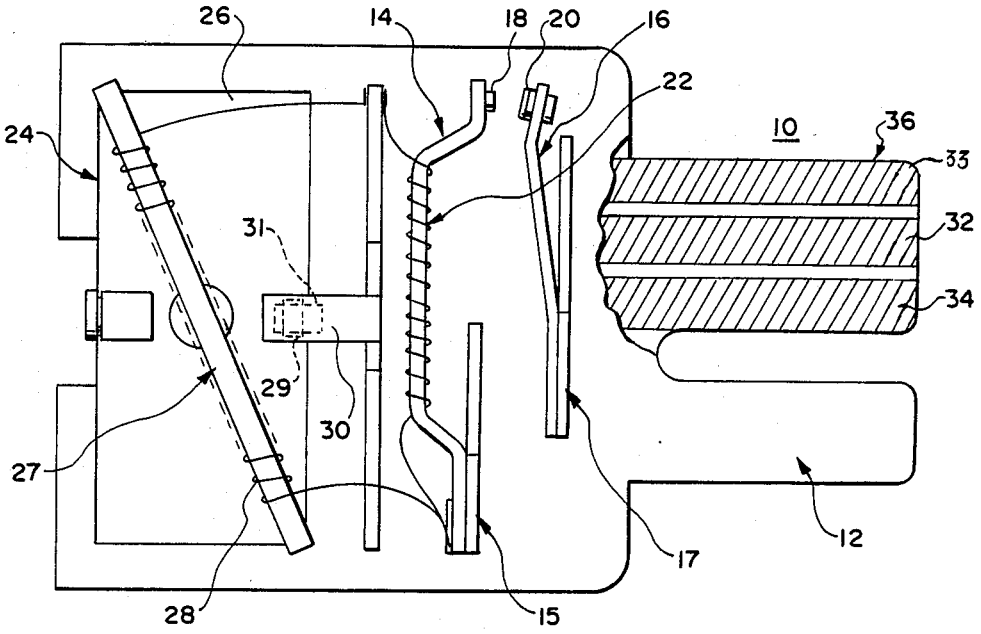
FIG. 1 is a top, plan view of a time delay relay according to the invention.

Referring now to the drawing in greater detail wherein like numerals have been employed in the two figures thereof to designate similar components, there is illustrated in FIG. 1, a preferred embodiment of a voltage and temperature compensated time delay relay 10 according to the invention.

The particular embodiment of the relay depicted in FIG. 1 includes a plug-in type circuit board 12 on which the time delay relay circuit elements are mounted.

As shown in FIG. 1, time delay relay 10 includes first and second bimetallic elements 14, 16, respectively. Each element is mounted on printed circuit board 12 by means of a mounting arm 15, 17, respectively. In the embodiment shown, mounting arm 17 is adjustable to vary the relative positions of the elements, thereby to alter the delay time of the relay.

Each element carrys a contact 18, 20, respectively. The elements are positioned with the contacts thereof in closely adjacent, but normally non-engaging or normally "open" relationship. A heater coil 22, is wrapped about bimetallic element 14 for applying heat to element 14. The heating of element 14 causes it to bend towards element 16, thereby closing contact 18 thereof against contact 20 of bimetallic element 16.

The bimetallic elements 14, 16, are chosen to bend in a like manner in accordance with changes in ambient temperature, thereby to maintain the spacing between contacts 18, 20, relatively consistent despite ambient temperature variations.

Time delay relays of the type described heretofore which employ bimetallic, contact carrying elements for compensation of ambient temperature changes, are conventional.

To compensate for variations in voltage applied to heater coil 22 wrapped about the active bimetallic element 14, which could upset the time delay period of the relay, there is provided a shunt type automotive flasher circuit 24 having a flashing or intermittent rate of operation which varies in accordance with the magnitude of the input voltage applied thereto. Flasher 24 includes a mechanically biased member, such as, a snap blade 26, a thermally expansible pull member 27 attached to the snap blade, a heater element 28, a movable contact 29 mounted on the snap blade and a fixed contact carrying element 30, mounted with its contact 31 positioned in cooperative, make-and-break, relationship with movable contact 29.

Input voltage is applied through the flasher circuit 24 to the time delay relay heater coil 22. In the embodiment of the relay shown in FIG. 1, points 32, 33, 34, on the plug in, tongue portion 36 of the printed circuit board 12, correspond to similarly numbered points on the circuit diagram of FIG. 2.

As can be seen, the applied DC voltage is pulsed by means of flasher circuit 24, to heater coil 22 of the relay. As such, the time that power is applied to the heater coil 22 produces an equal rate of temperature rise in the active bimetallic element 14, despite variations in the magnitude of the input voltage. The variable pulses of voltage applied to heater coil 22 of relay 10 vary in accordance with the flashing rate of flasher circuit 24.

In a typical application, a 16 volt power supply voltage causes the flasher to operate at approximately 30 flashes per minute (FPM), having a 20% "on" time. This results in the application of a relatively high voltage (16 volts), applied in short pulses to heater coil 22. At a 9 volt supply voltage, the flashing rate of the same flasher circuit is zero FPM and has a 100% "on" time. In this case, power is constantly applied to the heater coil 22.

The short power pulses provided by the flasher circuit when a 16 volt supply voltage is available, generates the same rate of heat rise in the heater coil 22 and bimetallic element 14 as does the constant "on" application of power to the heater coil when a 9 volt supply voltage is available. As such, the heating of coil 22 and element 14 remains the same despite input voltage variations and as such maintains the time delay period of the relay substantially constant.

The flasher circuit selected is one in which the flashing rate versus voltage is inherent in its design. The "off" time remains constant while the "on" time varies inversely proportionally with an increase in the magnitude of the supply voltage; i.e. a higher magnitude of supply voltage produces a shorter "on" time.

Figure 2:
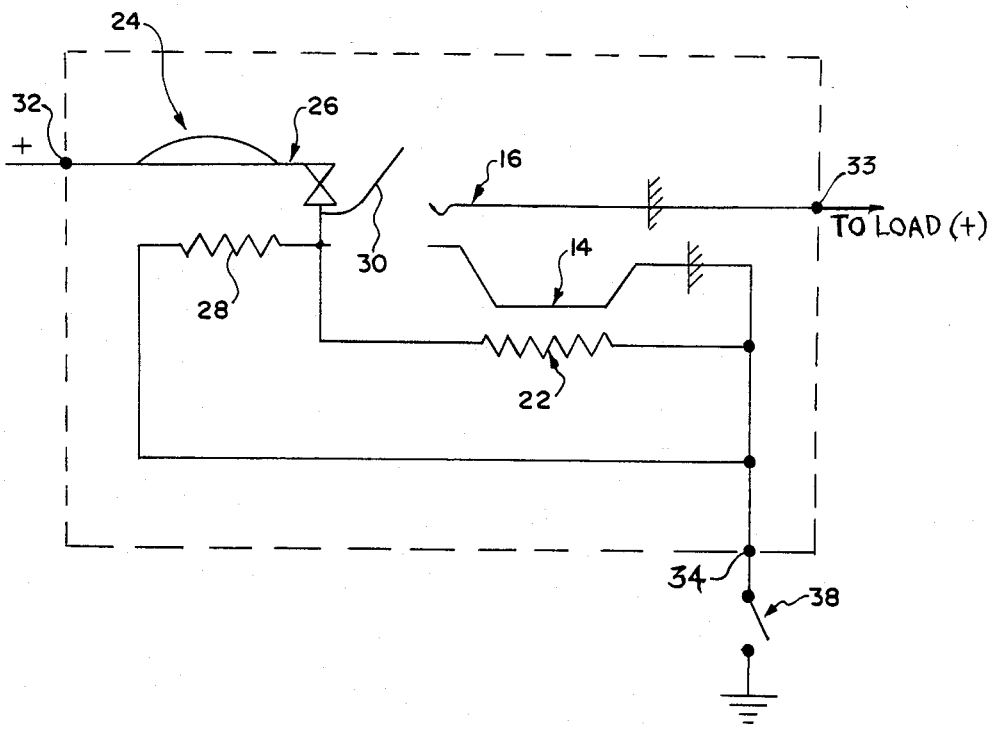
FIG. 2 is a schematic representation of the circuit of the time delay relay of FIG. 1.

As seen in the circuit diagram of FIG. 2, the flasher coil 28 and heater coil 22 of the time delay relay are connected electrically in parallel. The "on" time of the heater coils is controlled by the normally closed flasher contacts. The time cycle of the time delay relay 10 is initiated by closing switch 38 (FIG. 2). Once the cycle is completed, switch 38 is opened to permit bimetallic element 14 which is then closed, to return to it's normal "open" position. Subsequent cycles are also achieved through the operation of switch 38.

Typically, the time delay relay according to the invention can be used in the automotive industry for controlling the operation of a dashboard mounted warning light, automobile headlamps, windshield wipers and the like equipment. The circuit according to the invention assures reliable operation of such equipment and in other applications as well, despite voltage variations from a voltage source, such as, for example, an automotive battery.

While a particular embodiment of the invention has been shown and described, it should be understood that the invention is not limited thereto since many modifications may be made. It is therefore contemplated to cover by the present application any and all such modifications as fall within the true spirit and scope of the appended claims.

I claim:

1. A temperature and voltage compensated time delay relay adapted to be coupled electrically to a source of supply voltage, the magnitude of which is subject to variations, said time delay relay including in combination;

first and second contact carrying bimetallic elements, electrically operated heating means positioned for heating said first bimetallic element to deflect said element with respect to said second element from a first open contact condition to a second closed contact condition, the time period for deflection of said first bimetallic element being dependent upon the heating time of said electrically operated heating means; and voltage control circuit means coupled electrically between said heating means and said source of supply voltage for varying the application of voltage from said source to said heating means in accordance with variations in the magnitude of said supply voltage in order to maintain the heating time of said heating means substantially constant despite voltage variations, said voltage control circuit means comprising intermittently operated electrical contacts operable between a first closed state for supplying voltage from said source to said heating means and to a second open state for removing the supply of voltage from said source from said heating means, the time period said voltage control circuit remains in said second open state being constant while the time period said voltage control means remains in said first closed state varies inversely proportionally with an increase in the magnitude of said supply voltage.

2. A temperature and voltage compensated time delay relay as claimed in claim 1 wherein said voltage control circuit means includes a flasher circuit comprising first and second normally closed contacts, a mechanically biased member carrying said first contact, the biasing force thereof maintaining said first and second contacts in said normally closed condition, a thermally active pull member coupled mechanically to said mechanically biased member, said thermally active pull member being deflected in response to the heating thereof for moving said mechanically biased member against said biasing force for separating said contacts, an electric heater element coupled thermally to said thermally active pull member for heating said pull member, said flasher circuit being interposed electrically between said voltage source and said electrically operated heating means for supplying voltage from said source to said electrically operated heating means only during the time said first and second flasher circuit contacts are closed, the time in which said flasher circuit contacts remain in said closed condition varying inversely proportionally to increases in the magnitude of said supply voltage for maintaining constant the heating of said electrically operated heating means despite variations in the magnitude of said supply voltage.

3. A temperature and voltage compensated time delay relay as claimed in claim 1 wherein said electrically operated heating means comprises a first heating coil coupled mechanically to said bimetallic element, the heating time of said heating coil controlling the deflection of said bimetallic element, wherein said contact means of said voltage control circuit means includes first and second normally closed contacts and wherein said voltage control circuit means further includes heat activated means on which said first contact is mounted for movement of said first contact out of engagement with said second contact in response to the predetermined heating of said heat activated means, a second heating coil coupled thermally to said heat activated means and electrically to said source of supply voltage for heating said heat activated means, said first and second heating coils being connected electrically in parallel whereby the deflection time of said bimetallic element in response to the heating thereof by said first heating coil remains substantially constant despite variations in the magnitude of said supply voltage.

4. A temperature and voltage compensated time delay relay as claimed in claims 2 or 3 wherein both said contact carrying elements are bimetallic elements, each having similar heat deflection characteristics for maintaining the contact gap therebetween substantially constant despite ambient temperature variations.

5. A temperature and voltage compensated time delay relay adapted to be coupled electrically to a source of supply voltage, the magnitude of which is subject to variations, said time delay relay including a combination; first and second electrical contact carrying bimetallic elements, at least one of which is a bimetallic element deflectable predeterminedly in response to the application of heat thereto, electrically operated heating means positioned for heating said first bimetallic element to deflect said element with respect to said second element, from a first normally open contact condition to a second closed contact condition, the time period for deflection of said first bimetallic element being dependent upon the heating time of said electrically operated heating means, and circuit means interposed electrically between said source of supply voltage and said electrically operated heating means including intermittantly operated first and second electrical contacts operable between a first closed state for supplying voltage from said source to said heating means and to a second open state for removing the supply of voltage from said source from said heating means for varying the average power in said heating means in response to variations in the magnitude of said supply voltage thereby to maintain the deflection time of first said bimetallic element substantially constant despite variations in the magnitude of said supply voltage.

6. A temperature and voltage compensated time delay relay as claimed in claim 5 and said electrical contacts including controlling means for controlling the time during which the electrical contacts are in the first closed state in inverse proportion to changes in the magnitude of said supply voltage.

7. A temperature and voltage compensated time delay relay as claimed in claim 6 wherein said controlling means includes heat activated means carrying said first electrical contact, said heat activated means including mechanical means for biasing said heat activated means to maintain said first and second electrical contacts in said first closed state and heating element means thermally coupled to said heat activated means and electrically coupled to said source of supply voltage, said heating element means being operated electrically by said supply voltage to heat said heat activated means for moving said first electrical contact out of engagement with said second electrical contact, said source of supply voltage being electrically disconnected from said heating element means in response to the movement of said first and second electrical contacts to said second open state, said mechanical biasing means returning said first and second electrical contacts to a closed condition upon disconnection of said heating element means from said voltage source.

8. A temperature and voltage compensated time delay relay as claimed in claim 7 wherein said electrically operated heating means includes a first heating coil wrapped about said bimetallic element for deflection thereof and wherein said heating element means thermally coupled to said heat activated means of said controlling means includes a second heating coil, said first and second heating coils being connected electrically in parallel, said first heating coil means being energized for heating said bimetallic element in accordance with the energization of said second heating coil, whereby the deflection time of said bimetallic element remains substantially constant despite variations in the magnitude of said supply voltage.

* * * * *